United States Patent [19]

Nagoshi

[11] 4,357,092

[45] Nov. 2, 1982

[54] IMAGE RECORDING APPARATUS

[75] Inventor: Mitsuru Nagoshi, Hachioji, Japan

[73] Assignee: Konishiroku Photo Industry Co., Ltd., Tokyo, Japan

[21] Appl. No.: 186,370

[22] Filed: Sep. 12, 1980

[30] Foreign Application Priority Data

Sep. 14, 1979 [JP] Japan ..... 54/118032

[51] Int. Cl.[3] ..... G03G 15/14; G03G 15/24

[52] U.S. Cl. ..... 355/3 TR; 271/312; 271/DIG. 2; 355/3 CH; 355/3 SH

[58] Field of Search ..... 355/3 R, 3 TR, 3 CH, 355/3 SH, 15; 271/307, 311, 312, DIG. 2

[56] References Cited

U.S. PATENT DOCUMENTS 3,620,615 11/1971 Volkers ..... 355/3 R
4,006,987 2/1977 Tomono et al. ..... 355/15
4,017,065 4/1977 Poehlein ..... 355/3 R X
4,201,465 5/1980 Oyama et al. ..... 355/3 CH X

*Primary Examiner*—Fred L. Braun
*Attorney, Agent, or Firm*—Jordan B. Bierman; Linda G. Bierman

[57] ABSTRACT

In an electrophotographic copying apparatus a substantial saving of space is realized at the image-transfer-separation area by providing the transfer electrode with a shield having an open face opposite the photosensitive drum and an open end adjacent which a grounded separation roller is mounted. The separation roller acts as an end plate of the shield and receives a charge from the transfer electrode. The charged separation roller rotating at the same peripheral speed as the drum thereby attracts the transfer paper from the drum to the roller, thereby separating the paper from the drum.

3 Claims, 3 Drawing Figures

IMAGE RECORDING APPARATUS

BACKGROUND OF THE INVENTION

The present invention relates to an image transfer type image recording apparatus such as an electrophotographic copying apparatus, particularly to improvements on the image transfer-separation section.

As is generally known, in an image recording apparatus such as electrophotographic copying apparatus, image transfer paper (referred to as transfer paper, hereinafter) such as plain paper is fed onto an image bearing member (e.g., a photosensitive drum) on which a toner image is formed; said toner image is transferred onto the transfer paper by a transfer electrode device such as a corona discharging device as shown by FIG. 1 being positioned behind the image transfer paper. The transfer paper then is separated from the image support by a separation device (e.g., a separation roller, a stretched fixed belt of which a portion is in frictional contact with the surface of the photosensitive drum, or a combination of such means) which is adjacent to said transfer electrode device.

In an image transfer-separation section in which such methods are put into practice, it is desirable to construct said section so that the transfer paper may be conveyed as smoothly as possible. On the other hand, however, the compactness of the apparatus is requested nowadays from the view point of space-saving, necessitating that the diameter of the image support such as a photosensitive drum be minimized. To satisfy the latter requirement, the smaller the diameter of the image support with the other elements arranged to give full play to their normal function, the more it can not help arranging a forced conveyance path of transfer paper from the image transfer section through the separation section. For example, in a conventional apparatus using a roller as a separation means, the gap between the image transfer section and the separation section thereof is a distance of 30–40 mm.

The gap as described herein means the length of tangent line 100 (refer to FIG. 2) which touches the peripheries of both the drum and the separation roller, and which intersects the lines drawn from the center of the drum to the center of the transfer electrode and to the center of the separation roller, respectively.

Such being the case, when stiff paper such as paper having the weight of heavier than 70 kg, or curly paper is used as a transfer paper, the rear end of the transfer paper will not come into close contact with the image support, and consequently the defect of so-called poor transfer will be caused, that is, the efficiency of transfer will be lowered at the rear end of the transfer paper. A forced conveyance path of transfer paper also means that there is long period of contact time of the image support with an image transfer paper. Such being the case, it can cause such a defect that image quality will be lowered if there is any difference between the speeds of transfer of the paper conveyance and of the image support surface.

In such types of conventional electrostatic image recording apparatus, there has been a natural limitation to shorten the contact time of transfer paper by making the transfer electrode device closer to the separation device by their very design, because the corona discharger having a "U" shape sectional surface opposite and open to the image support is used as the transfer electrode device.

SUMMARY OF THE INVENTION

An object of the present invention is to propose an improvement of an apparatus of which a side portion of the transfer electrode device is made open adjacent to the separation device, and a part of the separation device such as a grounded electroconductive roller is closely located on the upper side of the transfer electrode device in the moving direction of a transfer paper.

This invention will become more apparent from the description of an embodiment taken in conjunction with an accompanying drawings.

DETAILED DESCRIPTION OF THE PREFERRED EMBODIMENT

Figure 1:
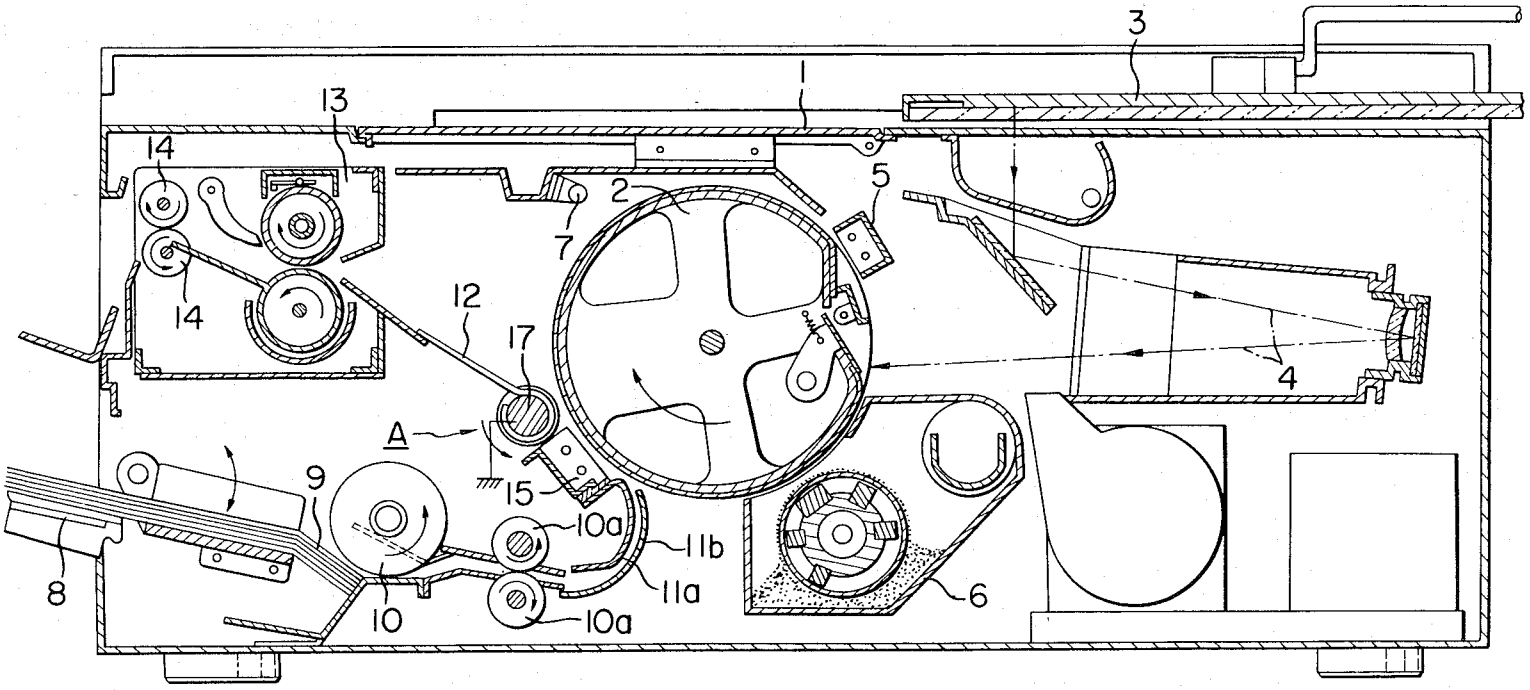
FIG. 1 is a general cross-sectional view of an electrophotographic copying machine to which the present invention is applied.

In FIG. 1, a photosensitive drum 2, i.e., an image support being driven to revolve in the direction of the arrow is built into the housing 1. In this embodiment, a zinc oxide photosensitive sheet is provided on the drum surface. It may be used on a drum having photosensitive layer made by Se, CdS or the like. The image of an original to be copied, which is held on a copy board 3 positioned at the upper part of the housing 1, is focussed through an optical system 4 for exposure to light, which may include a lamp, a lens and mirrors (none of which is indicated by numeral), onto the peripheral surface of the photosensitive drum 2 adjacent to the charging electrode 5. Around the surface of said photosensitive drum 2, the developing-cleaning device 6, the transfer-separation section A and the electric neutralizing lamp 7 are arranged in order in the direction of rotation of said drum.

Figure 2:
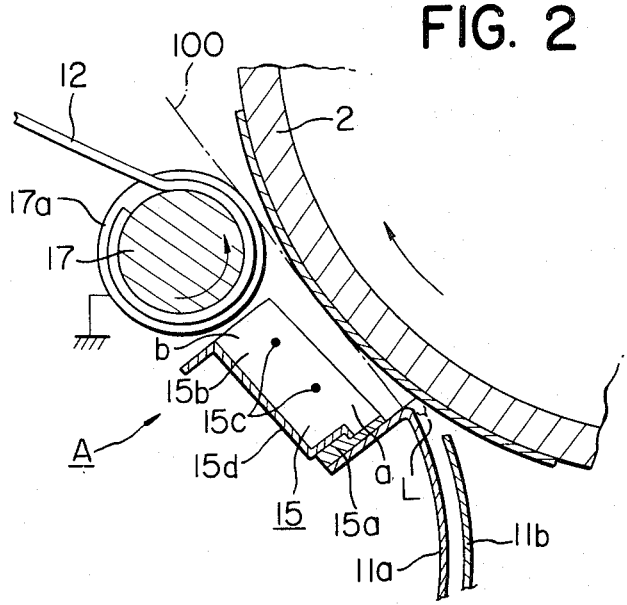
FIG. 2 is an expanded sectional view of an image transfer-separation section of said electrophotographic copying machine.
Figure 3:
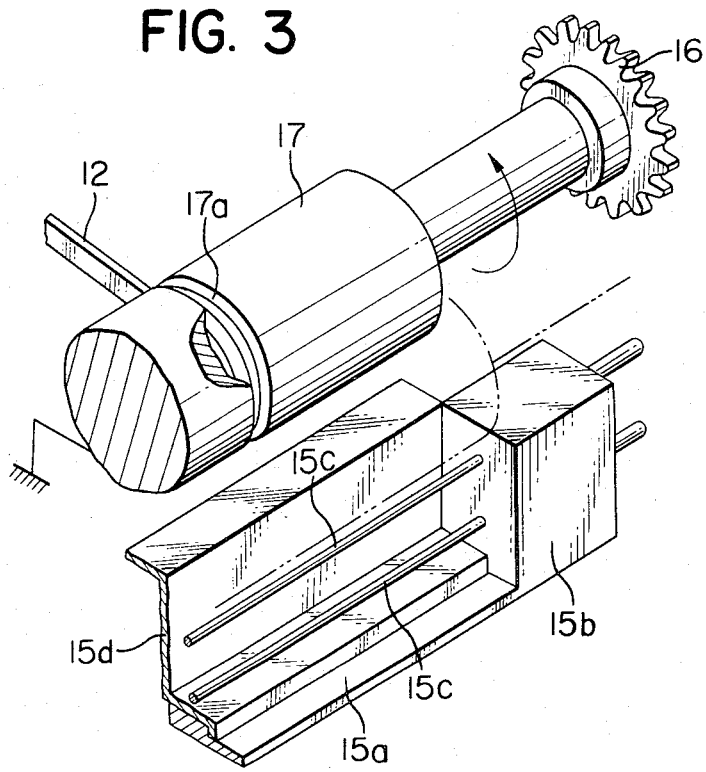
FIG. 3 is an enlarged exploded perspective view of a main part of said image transfer-separation section.

Transfer paper 9 on the paper feeding table 8 is fed from the paper feeding guides 11*a* and 11*b* onto the surface of the photosensitive drum 2 on the forward side of the image transfer-separation section A, through the first paper feeding roller 10 and the second paper feeding rollers 10*a* which rotate synchronously at the same rotational speed as the drum 2. The second paper feeding rollers 10*a* initially grasp the edge of the transfer paper 9 which is conveyed by the first paper feeding roller 10, and are controlled in their driving action so that the paper feeding function may synchronize with the drum revolution. With reference to FIG. 2 and FIG. 3, in the image transfer-separation device A which is to be described hereinafter, the transfer paper 9 onto which a toner image was transferred and which was separated from the drum surface is guided by the guide 12, conveyed to the roller type fixing device 13, and then taken out onto the tray outside the machine by the action of the discharge roller 14.

FIG. 2 and FIG. 3 illustrate the details of the image transfer-separation section A. Therein, the transfer electrode device 15 is attached in any suitable manner to the head of the paper feeding guide 11*a* through the intermediate member 15*a* which is made of electrical insulating material. The transfer electrode device 15 itself consists of a shield comprising a side plate and the back plate 15*d* which respectively respectively extend coextensively with the longer side of the member 15*a*, the insulating blocks 15*b* which are fixedly set at both ends of said shield, and two electric discharging wires 15*c* stretched between said insulating blocks.

As is clear in FIG. 2, that part which forms the side plate is positioned on the left side of said shield, that is, on the upper end of the shield as seen in the moving direction of the transfer paper, and is bent in the opposite direction as compared with a conventional side plate. This part may be omitted, but if not cut off is bent so as to maintain stable electric discharging function of the electric discharging wire 15*c*. That is to say, in the transfer electrode device 15, its transverse section is made in shape of an "L", whereby the surface thereof opposite the photosensitive drum 2 and the end portion b of the rear part of the photosensitive drum as seen in the direction of revolution of the drum are open.

In accordance with the invention, at the position adjacent to the open portion b of the transfer electrode device 15, preferably at the position where a part of the outside circumference is placed at the position of the side plate of conventional apparatus, the electroconductive separation roller 17 is placed and is driven in the direction of arrow by means such as the gear 16 so as to keep its peripheral speed corresponding to that of the photosensitive drum 2. In this example, a portion of the outside circumference of the separation roller positioning on the side of the opened portion b is subject to an electric discharge from the wire 15, and acts as a side plate on the left side. The gap between the surface of roller 17 closest to the drum and the drum is approximately 1–2 mm. Said separation roller 17 is electrically grounded so that the transfer paper 9 may be attracted to the round surface of the roller and as described above, the roller may function as the metallic plate or an end plate of transfer electrode. On the surface of said separation roller 17, one or more loop-shaped grooves 17*a* are formed about which the end of the aforementioned guide member 12 is loosely wound.

It is of course possible that the end of the guide member 12 is not necessarily formed as mentioned above, but can be made as a plate with a part thereof corresponding to the position of said loop-shaped groove 17*a* extending into said groove.

In a device having the above mentioned structure, therefore, when the transfer paper 9 has been fed by the action of the paper feeding roller 10 into the image transfer-separation section A it passes through the gap between the photosensitive drum 2 and the transfer electrode device 15, and a toner image formed on the round surface of the photosensitive drum 2 is transferred onto the transfer paper 9. The transfer paper 9 on which a toner image was transferred is immediately electrostatically attracted to the separation roller 17 adjacent to the transfer electrode 15, peeled off being guided by the action of member 12, and then fixed.

As is obvious from the above description, when using the present invention, it is possible to position the separation device much closer to the transfer electrode device as compared with the conventional arrangement, and consequently to reduce the contact time and area of the transfer paper to an image support. This means that such conveyance path is formed so as not to interfere with the straight conveyance which is likely to occur after the separation of a tip of an image transfer paper used, especially when a stiff transfer paper having 70 kgs or heavier in weight is used. On the common tangent line 100 which is indicated by the dash-and-dot line tied to a part of outside circumference of the drum and a part of outside circumference of the separation roller, the rear end of the transfer paper will follow the path so formed. Even though contact of said rear end of the transfer paper with the drum may be bad, the problem of non-transfer or mistransfer of an image is remarkably improved. It may be easily understood the above description if considering the fact that, when the space between the roller 17 and the electrode is wide and the common tangent line is drawn between them, such line will be closer to the image transfer electrode side compared with the constitution of the invention, that is to say, when the rear end of the transfer paper separates from the outside circumference of the drum, the distance L between said rear end of the transfer paper and the drum will become far off.

In addition, when a thin paper having the weight of the order of 45 or 50 kgs is used as transfer paper, very few troubles such as "non-transfer" are caused, in comparison with the case using said double weight transfer paper.

Since the surface of said separation roller 17 is apt to become contaminated, therefore, it is advantageous to make use of cleaning means such as a brush in contact with said surface. Furthermore, in making use of two-component developer it is possible that carriers such as iron powders may adhere to said surface; therefore it is desirable to provide a brush and, at the same time, to arrange a magnet with it to avoid scattering of those carriers which were swept off by said brush, or, to avoid scattering of magnet toners which were swept off in making use of single component developer. Said transfer electrode may be of not only corotron but also a single wire.

Further, the image transfer efficiency as well as the separation efficiency are not lowered because the separation roller is made closer to the circumference surface of the drum.

This separation roller can of course be combined with a publicly known belt type separation system.

In addition, it may be possible to determine optionally the diameters of the drum, rollers, etc.

What is claimed is:

1. In an image recording apparatus having the function that transfer paper is fed onto an image support and a developed image is transferred onto the transfer paper by making use of a transfer electrode device positioned in juxtaposition and opposite to the image support, and the image transfer paper is separated from the image support by a separation device, the improvement which comprises a shield for the transfer electrode device open at the side facing and opposite to said image support and open at the end downstream in the direction of movement of the transfer paper, and in which said separation device comprises an electrically conductive grounded member positioned closely adjacent the open end to form an end plate for said shield and on the other hand closely adjacent said image support, whereby said grounded separation device attracts the transfer paper off the image support.

2. The improvement in an image recording apparatus according to claim 1 in which said image support is a rotating photosensitive drum and said separation device comprises a roller whose surface rotates in the same direction and at the same peripheral speed as said drum.

3. The improvement in an image recording apparatus according to claim 2, comprising a paper guide supported from said roller.

* * * * *